US011898337B2

(12) United States Patent
Zhou et al.

(10) Patent No.: US 11,898,337 B2
(45) Date of Patent: Feb. 13, 2024

(54) EFFORT-SAVING FLAP-TYPE DRAIN VALVE

(71) Applicant: XIAMEN R&T PLUMBING TECHNOLOGY CO., LTD., Fujian (CN)

(72) Inventors: Shunxing Zhou, Fujian (CN); Ruiliang Chen, Fujian (CN); Rongyu Zhang, Fujian (CN); Xingdong Wang, Fujian (CN)

(73) Assignee: XIAMEN R&T PLUMBING TECHNOLOGY CO., LTD., Fujian (CN)

( * ) Notice: Subject to any disclaimer, the term of this patent is extended or adjusted under 35 U.S.C. 154(b) by 0 days.

(21) Appl. No.: 17/799,066

(22) PCT Filed: Jul. 17, 2020

(86) PCT No.: PCT/CN2020/102666
§ 371 (c)(1),
(2) Date: Aug. 11, 2022

(87) PCT Pub. No.: WO2021/189725
PCT Pub. Date: Sep. 30, 2021

(65) Prior Publication Data

US 2023/0089999 A1 Mar. 23, 2023

(30) Foreign Application Priority Data

Mar. 24, 2020 (CN) ..... 202010210706.6

(51) Int. Cl.
*E03C 1/23* (2006.01)

(52) U.S. Cl.
CPC ..... *E03C 1/2304* (2013.01)

(58) Field of Classification Search
CPC ..... E03D 1/35; E03D 1/308
See application file for complete search history.

(56) References Cited

U.S. PATENT DOCUMENTS 4,467,482 A * 8/1984 Dyer ..... E03D 1/35 4/395
5,524,297 A * 6/1996 Harrison ..... E03D 1/308 4/325

(Continued)

FOREIGN PATENT DOCUMENTS

CN 2589526 Y 12/2003
CN 201620455 U 11/2010

(Continued)

OTHER PUBLICATIONS

International Search Report and Written Opinion dated Dec. 17, 2020 received in PCT/CN/2020/102666 filed Jul. 17, 2020 (13 pages).

*Primary Examiner* — Christine J Skubinna
(74) *Attorney, Agent, or Firm* — Wilmer Cutler Pickering Hale and Dorr LLP

(57) ABSTRACT

The present disclosure discloses an effort-saving flap-type drain valve, comprising a base with a drain port, a flapper capable of hermetically covering and connecting to the drain port, an actuator connected to the flapper, and a connecting rod rotationally connected to the base and the flapper at two ends respectively, wherein the actuator is capable of causing the flapper to rotate relative to the connecting rod, and the actuator is capable of simultaneously causing the flapper to rotate about a first rotation pivot formed at a position where the flapper is in contact with the base to initially open the drain port; and wherein the actuator is capable of causing the flapper and the connecting rod to rotate together about a second rotation pivot formed at a rotational connection between the connecting rod and the base to further open the drain port.

13 Claims, 10 Drawing Sheets

(56) References Cited

U.S. PATENT DOCUMENTS

| | | | | |
|---|---|---|---|---|
| 6,381,765 | B1 * | 5/2002 | Liu | E03D 1/142 4/393 |
| 7,281,279 | B2 | 10/2007 | Shieh | |
| 8,266,733 | B2 | 9/2012 | Jensen | |

FOREIGN PATENT DOCUMENTS

| | | | |
|---|---|---|---|
| CN | 207228265 | U | 4/2018 |
| CN | 111335421 | A | 6/2020 |

* cited by examiner

EFFORT-SAVING FLAP-TYPE DRAIN VALVE

CROSS-REFERENCE TO RELATED APPLICATIONS

The present application is a National Stage of International Application No. PCT/CN2020/102666 filed on Jul. 17, 2020, which claims the priority of the Chinese patent application No. 202010210706.6, entitled "EFFORT-SAVING FLAP-TYPE DRAIN VALVE" and filed on Mar. 24, 2020, both of which are incorporated herein by reference in their entireties.

TECHNICAL FIELD

The present disclosure relates to the technical field of bathroom drain valves, in particular, to an effort-saving flap-type drain valve.

BACKGROUND

In an existing flap-type drain valve, a flapper usually hermetically covers and connects to a drain port of a base. To discharge water, a chain is pulled such that the chain lifts up the flapper, thereby opening the drain port for water discharge.

The flapper of the existing flap-type drain valve is usually rotationally connected to the base through a connecting rod. Specifically, one end of the connecting rod is fixedly connected to the flapper, and the other end of the connecting rod is rotationally connected to a rotating shaft provided on the base, with a rotation pivot for the flapper to rotate being formed at a rotational connection between the connecting rod and the rotating shaft on the base.

SUMMARY

A technical solution adopted in the present disclosure to solve its technical problem is: an effort-saving flap-type drain valve, including a base with a drain port, a flapper capable of hermetically covering and connecting to the drain port, an actuator connected to the flapper, and a connecting rod rotationally connected to the base and the flapper at two ends respectively, wherein in a state where the flapper hermetically covers and connects to the drain port, as the actuator is driven, the actuator is capable of causing the flapper to rotate relative to the connecting rod, and the actuator is capable of simultaneously causing the flapper to rotate about a first rotation pivot formed at a position where the flapper is in contact with the base to initially open the drain port; and in a state where the drain port is initially opened, the actuator is capable of causing the flapper and the connecting rod to rotate together about a second rotation pivot formed at a rotational connection between the connecting rod and the base to further open the drain port.

In some embodiments, a first limiting structure is provided between the flapper and the connecting rod, the first limiting structure being capable of limiting an amplitude of rotation of the flapper relative to the connecting rod in the state where the drain port is initially opened, thereby limiting a size of initial opening of the drain port.

In some embodiments, the first limiting structure includes a first limiting face provided on the flapper and a second limiting face provided on the connecting rod, the first limiting face being capable of abutting against the second limiting face to limit a magnitude of rotation of the flapper relative to the connecting rod in the state where the drain port is initially opened.

In some embodiments, the flapper is capable of rotating between a first position and a second position relative to the connecting rod, and an elastic resetting element is provided between the flapper and the connecting rod, and the elastic resetting element is capable of resetting the flapper from the second position to the first position; in a state where the flapper is in the first position, the flapper is capable of hermetically covering and connecting to the drain port after falling down; and in a state where the flapper hermetically covers and connects to the drain port, as the actuator is driven, the actuator is capable of causing the flapper to rotate from the first position to the second position relative to the connecting rod, and capable of simultaneously causing the flapper to rotate about the first rotation pivot to initially open the drain port.

In some embodiments, a second limiting structure is provided between the flapper and the connecting rod, in the state where the flapper is in the first position, the second limiting structure only allowing the flapper to rotate unidirectionally in a direction toward the second position relative to the connecting rod.

In some embodiments, the second limiting structure includes a third limiting face provided on the flapper and a fourth limiting face provided on the connecting rod, the third limiting face being capable of abutting against the fourth limiting face to limit the flapper in the first position to only rotating unidirectionally in the direction toward the second position.

In some embodiments, the first limiting face is provided with a guide post, and the elastic resetting element is a spring sleeved on the guide post; the second limiting face is provided with an accommodating slot for insertion of the guide post and the spring; and the spring abuts against and is provided between the first limiting face and a bottom wall of the accommodating slot; or the second limiting face is provided with a guide post, and the elastic resetting element is a spring sleeved on the guide post; the first limiting face is provided with an accommodating slot for insertion of the guide post and the spring; and the spring abuts against and is provided between the second limiting face and a bottom wall of the accommodating slot.

In some embodiments, the flapper includes a flapper body, a shell mounted at the bottom of the flapper body, and a water stop pad mounted at the bottom of the flapper body, wherein an air chamber being formed between the shell and the flapper body, the base being provided with a water stop face at the periphery of the drain port, the water stop pad being capable of sealing itself against the water stop face so that the flapper hermetically covers and connects to the drain port, or being capable of separating from the water stop face so that the flapper opens the drain port; and in a process of initial opening of the drain port, the first rotation pivot is formed at a position where the water stop pad and the water stop face are in contact with each other.

In some embodiments, in a process of initial opening of the drain port, the first rotation pivot moves in a direction away from the second rotation pivot.

In some embodiments, the first limiting structure limits the amplitude of rotation of the flapper relative to the connecting rod to 5°-60°.

In some embodiments, the first limiting structure limits the amplitude of rotation of the flapper relative to the connecting rod to 7°-25°.

In some embodiments, the connecting rod is rotationally connected to the flapper through a first rotating shaft; the connecting rod is provided with a first through hole through which the first rotating shaft passes movably, and the flapper body is provided with a second through hole through which the first rotating shaft passes movably; limiting portions are provided at two ends of the first rotating shaft, respectively, and at least a through slot is formed at an end face of one end of the first rotating shaft so that the limiting portion is shrinkable and expandable.

In some embodiments, the actuator is a chain or a pull cord.

Figure 1:
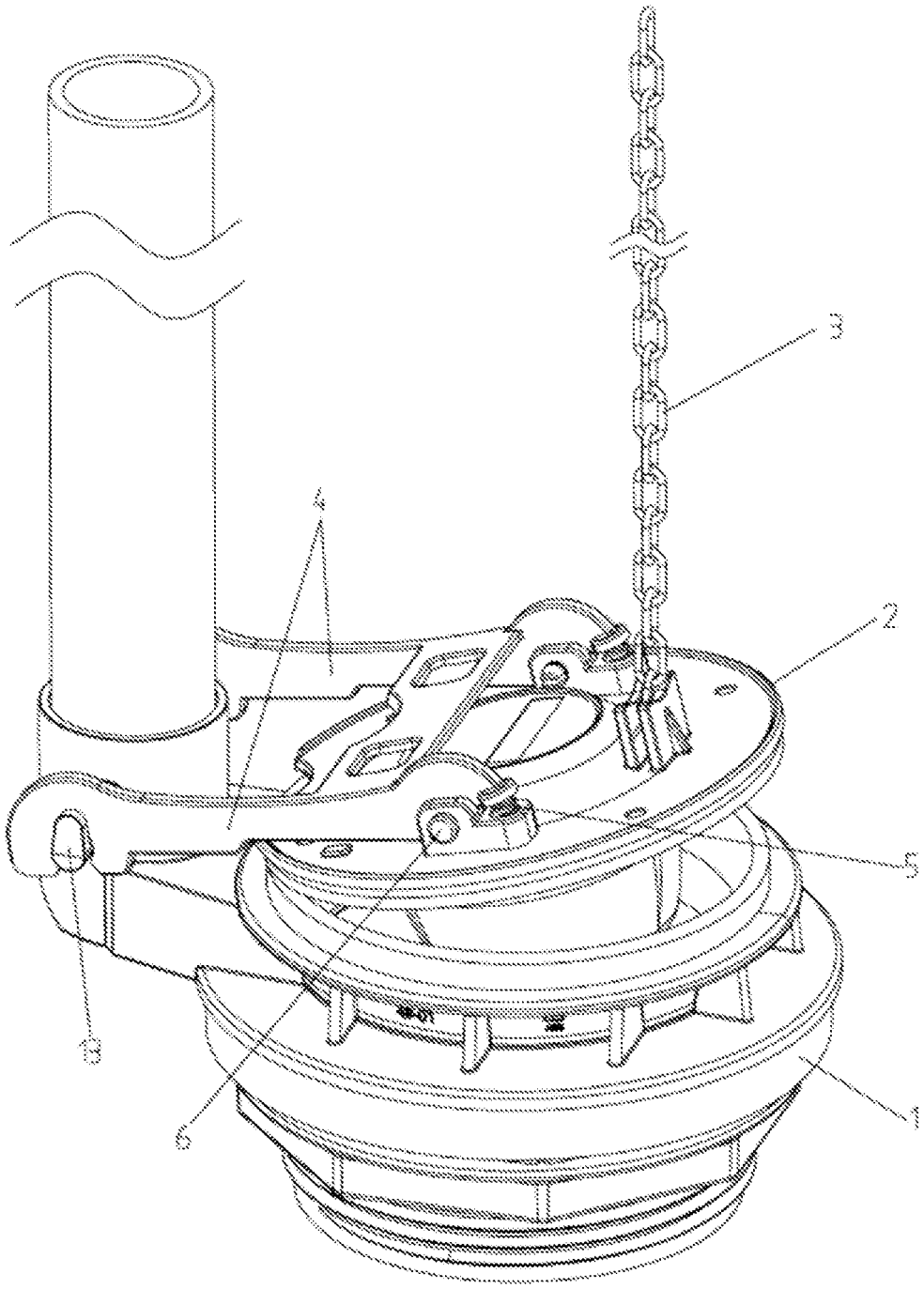
FIG. 1 is a three-dimensional structure diagram of the present disclosure.

Reference numerals are listed as follows:

1—base, 2—flapper, 3—actuator, 4—connecting rod, 5—elastic resetting element, 6—first rotating shaft, 11—drain port, 12—water stop face, 13—second rotating shaft, 21—flapper body, 211—first limiting face, 212—third limiting face, 213—accommodating slot, 214—second through hole, 22—shell, 23—water stop pad, 41—second limiting face, 42—fourth limiting face, 43—guide post, 44—first through hole, 45—U—shaped connecting slot, 61—limiting portion, 62—through slot.

DETAILED DESCRIPTION

The present disclosure is further described in detail below in conjunction with the drawings and embodiments; however, an effort-saving flap-type drain valve of the present disclosure is not limited to the embodiments.

A force value required to pull the flapper of the existing flap-type drain valve is still large. How to further reduce the force value required to pull the flapper is an urgent technical problem to be solved.

In order to save effort in pulling the flapper, the existing flap-type drain valve usually uses the principle of effort-saving leverage to pull the flapper so as to open the drain port for water discharge. That is, a power arm (i.e., a distance from a line of action of a pulling force for pulling the flapper to the rotation pivot) of the flapper of such a flap-type drain valve is usually longer than a resistance arm (i.e., a distance from a line of action of a pressure of water on the flapper to the rotation pivot). However, the inventor found that the reason why pulling the flapper of the existing flap-type drain valve is still laborious is that the ratio of the resistance arm to the power arm is large, so a large pulling force is required to lift the flapper so as to open the drain port.

The inventor also found that for the drain valve, in the process of opening the drain port for water discharge, the pressure of water on the flapper is the largest when the drain port is just opened by pulling the flapper, so the force value required to pull the flapper at that time is large, and when the flapper is lifted a small distance such that the drain port is slightly opened, the pressure of water on the flapper becomes smaller, and the force value required to pull the flapper at that time naturally becomes smaller. In view of this, the present disclosure proposes an effort-saving flap-type drain valve capable of opening a drain port in stages, based on the findings of the inventor, in order to solve the problems in the background art.

The present disclosure provides an effort-saving flap-type drain valve, which overcomes the shortcomings of the existing flap-type drain valve.

Compared with the prior art, the present disclosure has the following beneficial effects:

The structure of the present disclosure is simple, and by rotationally connecting the connecting rod to the flapper, when the flapper hermetically covers and connects to the drain port, as the actuator is driven, the actuator is capable of causing the flapper to rotate relative to the connecting rod, and the actuator is capable of simultaneously causing the flapper to rotate about the first rotation pivot formed at the position where the flapper is in contact with the base to initially open the drain port; and after the drain port is initially opened, the actuator is capable of causing the flapper and the connecting rod to rotate together about the second rotation pivot formed at the rotating connection between the connecting rod and the base to further open the drain port. Compared with the existing flap-type drain valve, the present disclosure has the advantages that in the process of initial opening of the drain port, the resistance arm and the power arm are both smaller than those in the prior art, and the ratio of the resistance arm to the power arm is also smaller than that in the prior art, so the pulling force required to pull the flapper is smaller, thereby achieving improvement of the pulling force value; in the process of further opening of the drain port, since the flapper has rotated a certain angle relative to the base and the drain port has been opened initially, the pressure applied to the flapper by water is reduced, and the pulling force required to pull the flapper is also reduced accordingly; at that time, appropriately increasing the resistance arm and the power arm, on the one hand, can keep the pulling force within a range of smaller values, and on the other hand, can ensure that the opening amplitude of the drain port is large enough to ensure a water discharge speed of the drain port, thereby achieving improvement of the pulling force value required to pull the flapper on the premise of ensuring normal water discharge.

The present disclosure cleverly uses a stagewise water discharge method, which greatly reduces the force value of pulling the flapper in the initial opening stage of the drain port; and after the initial opening stage of the drain port, the resistance arm and the power arm are increased by the change of the rotation pivot, to ensure that the drain port can be fully opened, and in the further opening stage of the drain port, since the flapper has rotated a certain angle relative to the base, the water pressure on the flapper is smaller at that time, and thus the increase of the resistance arm and the power arm does not lead to an increase in pulling force, such that the entire process of pulling the flapper has a low pulling force value, and opening the drain valve is more effort-saving.

In some embodiments, referring to FIGS. 1 to 11, an effort-saving flap-type drain valve of the present disclosure includes a base 1 with a drain port 11, a flapper 2 capable of hermetically covering and connecting to the drain port 11, an actuator 3 connected to the flapper 2, and a connecting rod 4 rotationally connected to the base 1 and the flapper 2 at two ends respectively; in a state where the flapper 2 hermetically covers and connects to the drain port 11, as the actuator 3 is driven, the actuator 3 is capable of causing the flapper 2 to rotate relative to the connecting rod 4, and the actuator 3 is capable of simultaneously causing the flapper 2 to rotate about a first rotation pivot Q1 formed at a position where the flapper 2 is in contact with the base 1 to initially open the drain port 11; and after the drain port 11 is initially opened, the actuator 3 is capable of causing the flapper 2 and the connecting rod 4 to rotate together about a second rotation pivot Q2 formed at a rotational connection between the connecting rod 4 and the base 1 to further open the drain port 11.

Figure 6:
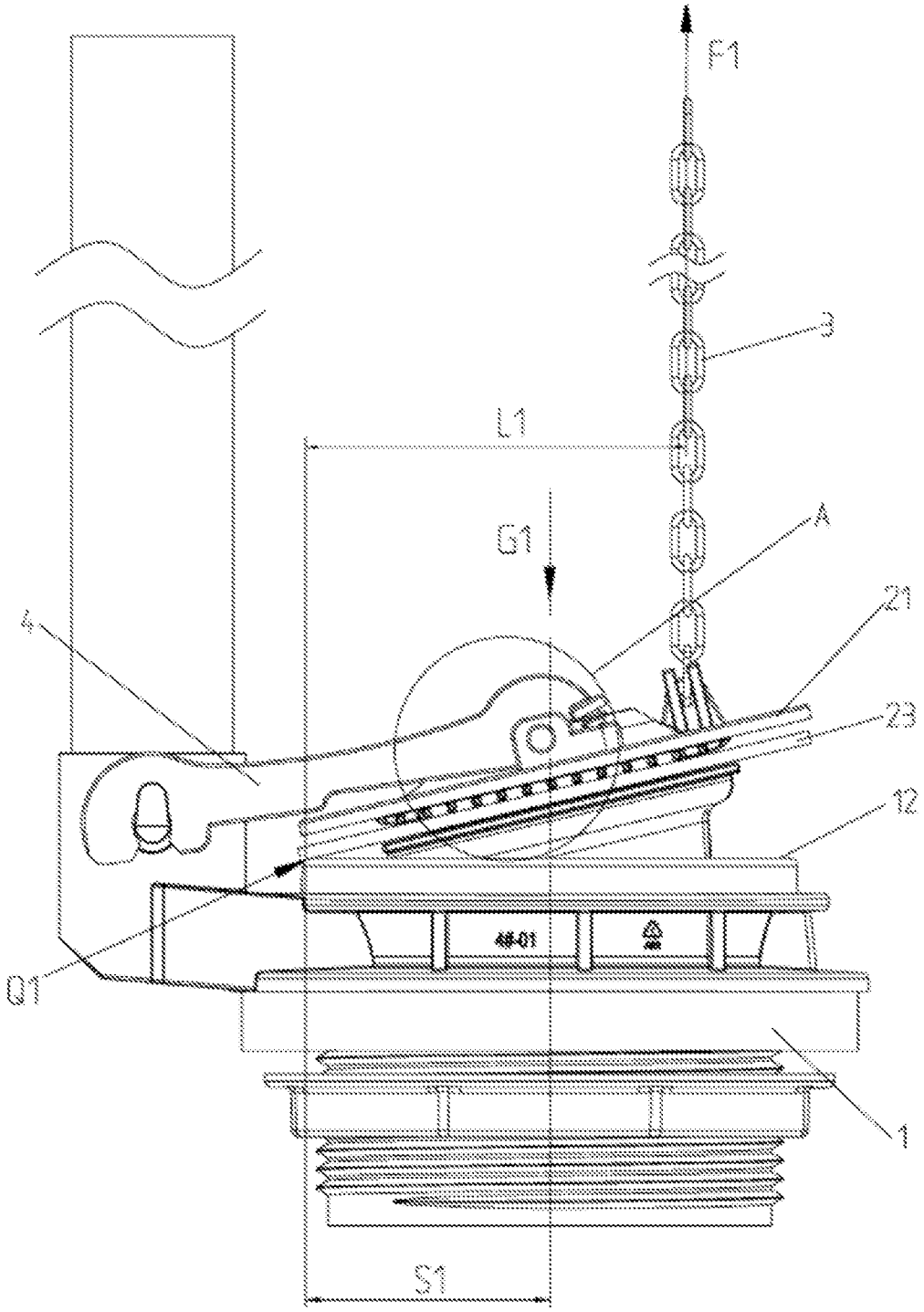
FIG. 6 is a state diagram of the present disclosure during the initial opening of a drain port.
Figure 8:
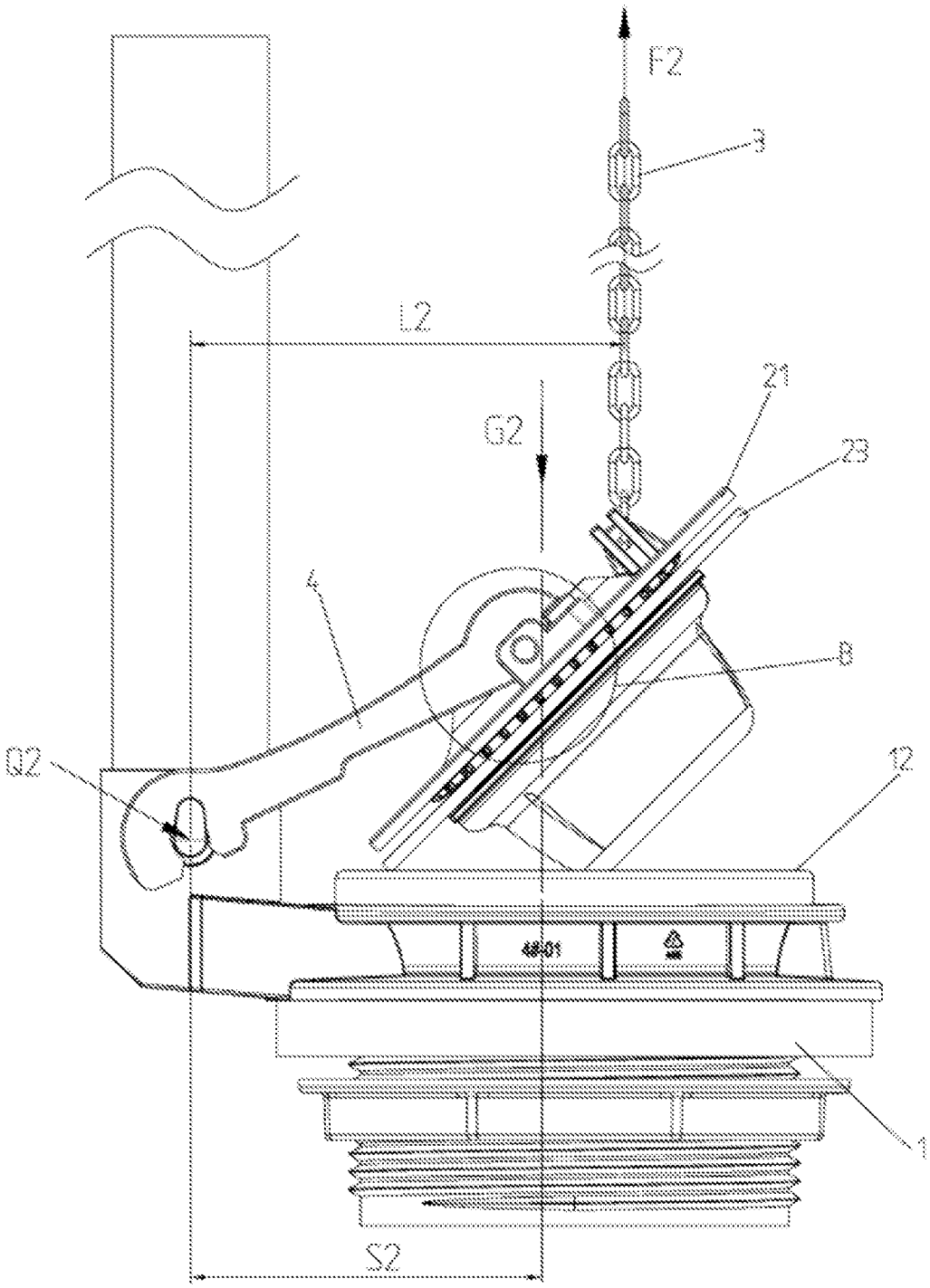
FIG. 8 is a state diagram of the present disclosure when initial opening of the drain port is completed (i.e., an initial state diagram of further opening of the drain port of the present disclosure)

In this embodiment, referring to FIG. 6, in the process of initial opening of the drain port 11, a power arm L1 is a distance from a line of action of a pulling force F1 of the actuator 3 pulling the flapper 2 to the first rotation pivot Q1, and a resistance arm S1 is a distance from a line of action of a resultant force G1 of water acting on the flapper 2 to the first rotation pivot Q1; the power arm L1 is set to be larger than the resistance arm S1, and the connection location between the actuator 3 and the flapper 2 and the first rotation pivot Q1 are distributed on two sides of the line of action of the resultant force G1 of water acting on the flapper 2, so that the actuator 3 can pull the flapper 2 according to the principle of effort-saving leverage in the process of initial opening of the drain port 11; compared with the existing flap-type drain valve, the resistance arm S1 and the power arm L1 re both reduced, and the ratio of the resistance arm S1 to the power arm L1 is reduced, so the pulling force required to pull the flapper 2 is reduced; and referring to FIG. 8, in the process of further opening of the drain port 11, a power arm L2 is a distance from a line of action of a pulling force F2 of the actuator 3 pulling the flapper 2 to a second rotation pivot Q2, and a resistance arm S2 is a distance from a line of action of a resultant force G2 of water acting on the flapper 2 to the second rotation pivot Q2; the power arm L2 is set to be larger than the resistance arm S2, and the connection location between the actuator 3 and the flapper 2 and the second rotation pivot Q2 are distributed on two sides of the line of action of the resultant force G2 acting on the flapper 2, so that the actuator 3 can pull the flapper 2 according to the principle of effort-saving leverage in the process of further opening of the drain port 11, to cause the flapper 2 and the connecting rod 4 to rotate about the second rotation pivot Q2 at the same time; in the process of further opening of the drain port 11, since the flapper 2 has rotated a certain angle relative to the base 1 and the drain port 11 has been opened initially, the pressure applied to the flapper 2 by water is reduced, and the pulling force required to pull the flapper 2 is also reduced accordingly; at that time, appropriately increasing the resistance arm and the power arm, on the one hand, can keep the pulling force within a range of smaller values, and on the other hand, can ensure that the opening amplitude of the drain port is large enough to ensure a water discharge speed of the drain port, thereby achieving improvement of the pulling force value required to pull the flapper on the premise of ensuring normal water discharge.

Referring to FIGS. 1 to 11, in this embodiment, the flapper 2 includes a flapper body 21, a shell 22 mounted at the bottom of the flapper body 21, and a water stop pad 23 mounted at the bottom of the flapper body 21, wherein an air chamber (not shown) being formed between the shell 22 and the flapper body 21 to control a falling speed of the flapper 2 when the drain valve discharges water, the base 1 being provided with a water stop face 12 at the periphery of the drain port 11, the water stop pad 23 being capable of sealing itself against and separating from the water stop face 12 so that the flapper 2 hermetically covers and connects to the drain port 11; and in the process of initial opening of the drain port 11, the first rotation pivot Q1 is formed at a position where the water stop pad 23 and the water stop face 12 are in contact with each other.

Referring to FIGS. 1 to 11, in this embodiment, the flapper 2 is capable of rotating between a first position and a second position relative to the connecting rod 4, and an elastic resetting element 5 is provided between the flapper 2 and the connecting rod 4, and the elastic resetting element 5 is capable of resetting the flapper 2 from the second position to the first position; in a state where the flapper 2 is in the first position, the flapper 2 is capable of hermetically covering and connecting to the drain port 11 after falling down; and in a state where the flapper 2 hermetically covers and connects to the drain port 11, as the actuator 3 is driven, the actuator 3 is capable of causing the flapper 2 to rotate from the first position to the second position relative to the connecting rod 4, and capable of simultaneously causing the flapper 2 to rotate about the first rotation pivot Q1 formed at the position where the flapper 2 is in contact with the base 1 to initially open the drain port 11. In this embodiment, by providing the elastic resetting element 5 between the flapper 2 and the connecting rod 4, after the flapper 2 rotates from the first position to the second position under the drive of the actuator 3, the flapper 2 can automatically return from the second position to the first position under the action of the elastic resetting element 5, thereby ensuring that the flapper 2 can hermetically cover and connect to the drain port 11 when falling down after the end of water discharge, to avoid that the flapper 2 is inserted obliquely in the drain port 11 and thus fails to be completely reset to a sealed state with the drain port 11, resulting in water leakage; in particular, in the case where the flapper 2 is designed such that the flapper 2 rotates relative to the connecting rod 4 at a larger amplitude in the process of initial opening of the drain port, the problem that the flapper 2 is inserted obliquely in the drain port 11 is more likely to occur, and in this case, with the elastic resetting element 5, after an external force is removed, the flapper 2 can automatically return from the second position to the first position, which can effectively avoid the problem that the flapper 2 is inserted obliquely in the drain port 11, and ensure that the flapper 2 can be sealed perfectly with the drain port 11 after falling back, thus achieving a more reliable function.

In this embodiment, a first limiting structure is provided between the flapper 2 and the connecting rod 4, the first limiting structure being capable of limiting the amplitude of rotation of the flapper 2 relative to the connecting rod 4 in the state where the drain port 11 is initially opened, thereby limiting a size of initial opening of the drain port 11. That is, when the flapper 2 is in the second position, the first limiting structure only allows the flapper 2 to rotate in a direction toward the first position relative to the connecting rod 4, so that after the flapper 2 rotates relative to the connecting rod 4 from the first position to the second direction, the flapper cannot continue rotating in the original direction, and thus the rotation amplitude of the flapper 2 relative to the connecting rod 4 is small when the drain port 11 is initially opened is small, to avoid that when the drain port 11 is initially opened, the flapper 2 rotates relative to the connecting rod 4 at a large amplitude such that after being reset, the flapper 2 cannot be completely fit to the base 1 (i.e., the water stop pad 23 cannot be completely sealed against the water stop face 12) to hermetically cover and connect to the drain port 11. Referring to FIGS. 3 to 11, in this embodiment, the first limiting structure can limit the angle of rotation of the flapper 2 relative to the connecting rod 4, when the drain port 11 is initially opened, to an acute angle, which is preferably in the angle range of 5° to 60°, more preferably 7° to 25°, which angle range has a better effect of improving the force value. The first limiting structure includes a first limiting face 211 provided on the flapper body 21 and a second limiting face 41 provided on the connecting rod 4, the first limiting face 211 being capable of abutting against and coming into limiting fit with the second limiting face 41 to limit the magnitude of rotation of the flapper 2 relative to the connecting rod 4 when the drain port 11 is initially opened (i.e. to limit the flapper 2 in the second position to only rotating unidirectionally in the direction toward the first position).

In this embodiment, a second limiting structure is provided between the flapper 2 and the connecting rod 4, when the flapper 2 is in the first position, the second limiting structure only allowing the flapper 2 to rotate unidirectionally in a direction toward the second position relative to the connecting rod 4, so that the flapper 2 cannot continue rotating in the original direction after being reset from the second position to the first position relative to the connecting rod 4, to ensure that the flapper 2 can be accurately reset to the first position under the action of the elastic resetting element 5, so that the flapper 2 can hermetically cover and connect to the drain port 11. Referring to FIGS. 3 to 11, in this embodiment, the second limiting structure includes a third limiting face 212 provided on the flapper 2 and a fourth limiting face 42 provided on the connecting rod 4, the third limiting face 212 being capable of abutting against the fourth limiting face 42 to limit the flapper 2 in the first position to only rotating unidirectionally in the direction toward the second position. The third limiting face 212 is specifically a top surface of the flapper body 21, and the fourth limiting face 42 is specifically a bottom surface of the connecting rod 4.

Figure 9:
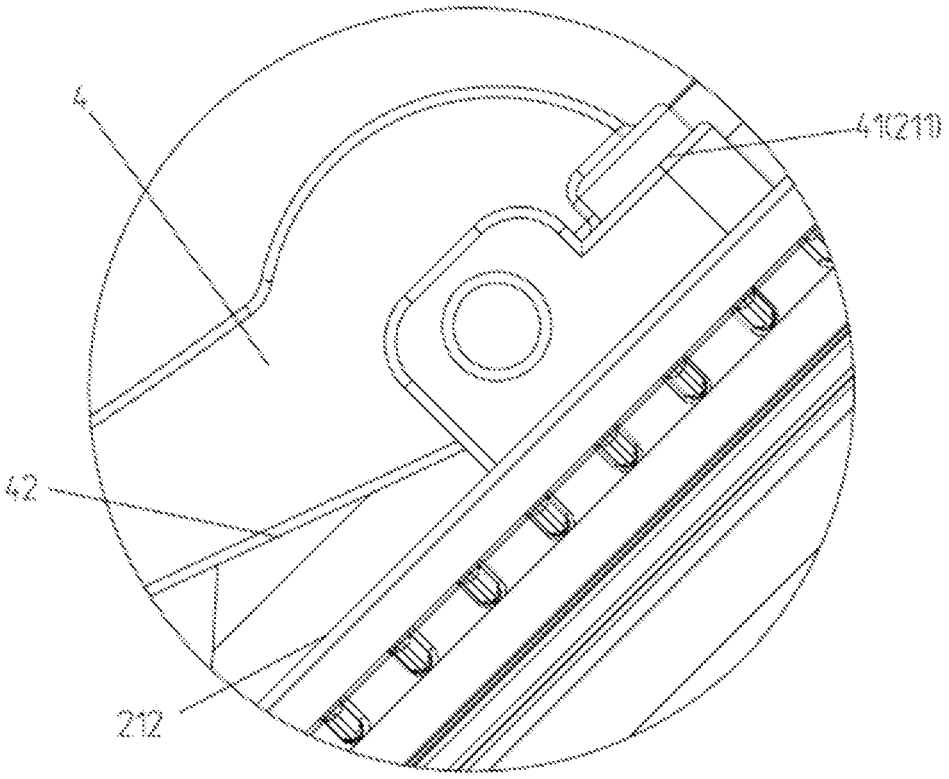
FIG. 9 is a partial enlarged diagram at B in FIG. 8.

In this embodiment, when the flapper 2 is in the second position, the first limiting structure only allows the flapper 2 to rotate in the first direction relative to the connecting rod 4; and when the flapper 2 is in the first position, the second limiting structure only allows the flapper 2 to rotate in the second direction relative to the connecting rod 4, the first direction and the second direction being opposite. In FIGS. 8 and 9, the flapper 2 is in the second position, using the direction shown in FIG. 8 as an example, the flapper 2 can only rotate clockwise relative to the connecting rod 4 in this case; and in FIGS. 10 and 11, the flapper 2 is in the first position, using the direction shown in FIG. 10 as an example, the flapper 2 can only rotate counterclockwise relative to the connecting rod 4 in this case.

Referring to FIGS. 1 to 4, in this embodiment, the second limiting face 41 is provided with a guide post 43, and the elastic resetting element 5 is a spring sleeved on the guide post 43, specifically a compression spring; the first limiting face 211 is provided with an accommodating slot 213 for insertion of the guide post 43 and the spring; and the spring abuts against the second limiting face 41 and a bottom wall of the accommodating slot 213. Of course, in other embodiments, it is also possible that the first limiting face 211 is provided with a guide post 43, and the second limiting face 41 is provided with an accommodating slot 213 for insertion of the guide post 43 and the spring, and the spring abuts against and is provided between the first limiting face 211 and a bottom wall of the accommodating slot 213; or, the elastic resetting element 5 is a reset torsion spring or reset tension spring provided between the flapper 2 and the connecting rod 4, which can also achieve the object of the present disclosure.

Referring to FIGS. 1 to 5, in this embodiment, one end of the connecting rod 4 is rotationally connected to the top of the flapper body 21 through a first rotating shaft 6; the connecting rod 4 is provided with a first through hole 44 through which the first rotating shaft 6 passes movably, and the flapper body 21 is provided with a second through hole 214 through which the first rotating shaft 6 passes movably; limiting portions 61 are provided at two ends of the first rotating shaft 6, respectively, and at least a through slot 62 is formed at an end face of one end of the first rotating shaft 6 so that the limiting portion 61 at the end of the first rotating shaft 6 formed with the through slot 62 is shrinkable and expandable, and thereby the limiting portion 61 at the end of the first rotating shaft 6 formed with the through slot 62 can elastically deform to some extent and thereby shrink when passing through the first through hole 44 or the second through hole 214, so as to smoothly pass through the first through hole 44 or the second through hole 214, and thus the limiting portion 61 can restore after passing through the first through hole 44 or the second through hole 214; a middle part of the first rotating shaft 6 movably passes through the first through hole 44 and the second through hole 214; the limiting portions 61 at the two ends of the rotating shaft 6 are in limiting fit with the peripheries of the first through hole 44 and the second through hole 214, respectively, to restrict the first rotating shaft 6 from escaping from the first through hole 44 and the second through hole 214; the other end of the connecting rod 4 is provided with a U-shaped connecting slot 45, and the base 1 is provided with a second rotating shaft 13, the U-shaped connecting slot 45 being buckled to the second rotating shaft 13 to achieve rotational connection of the connecting rod 4 and the base 1.

Figure 2:
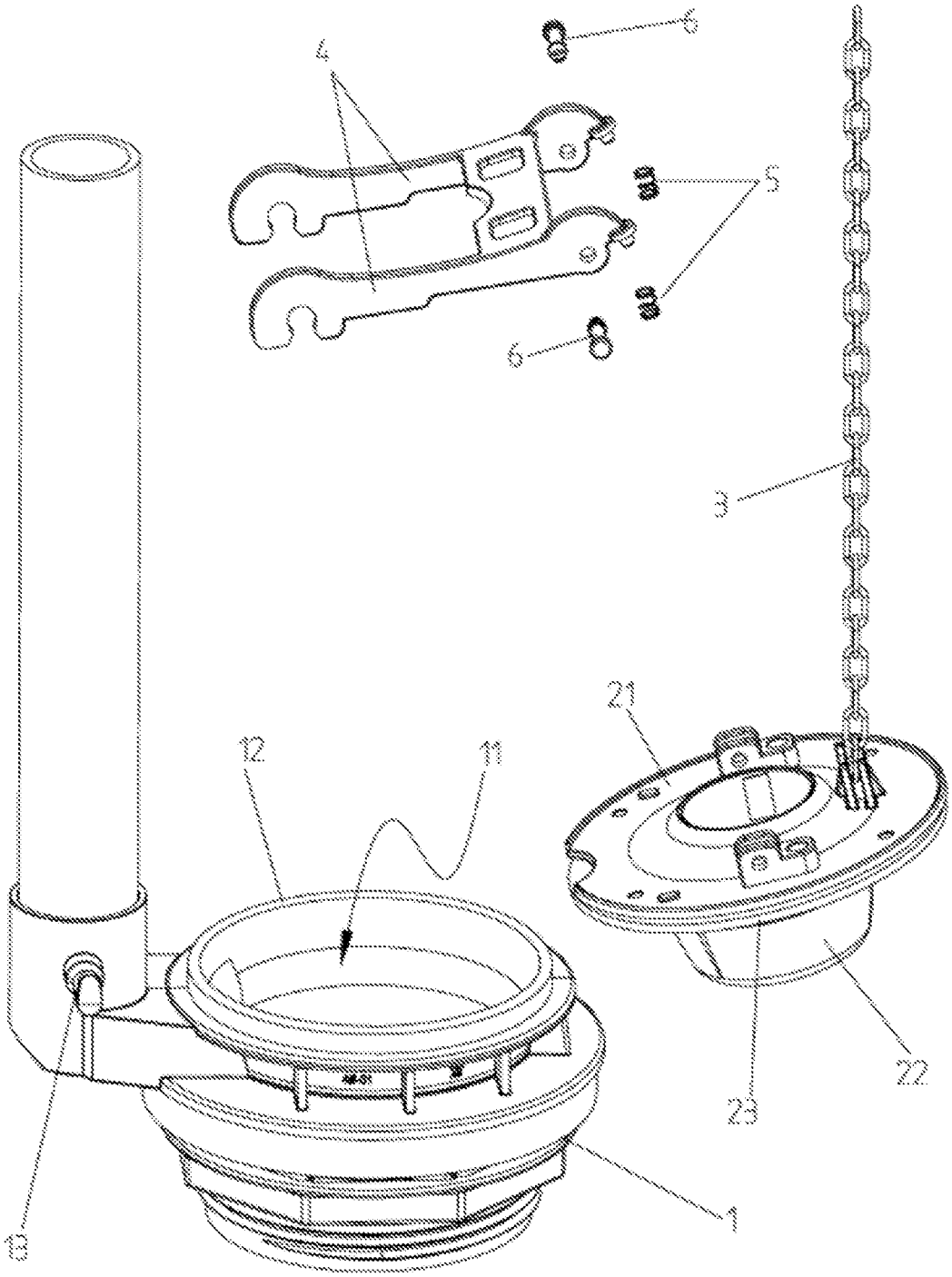
FIG. 2 is an exploded structure diagram of the present disclosure.
Figure 3:
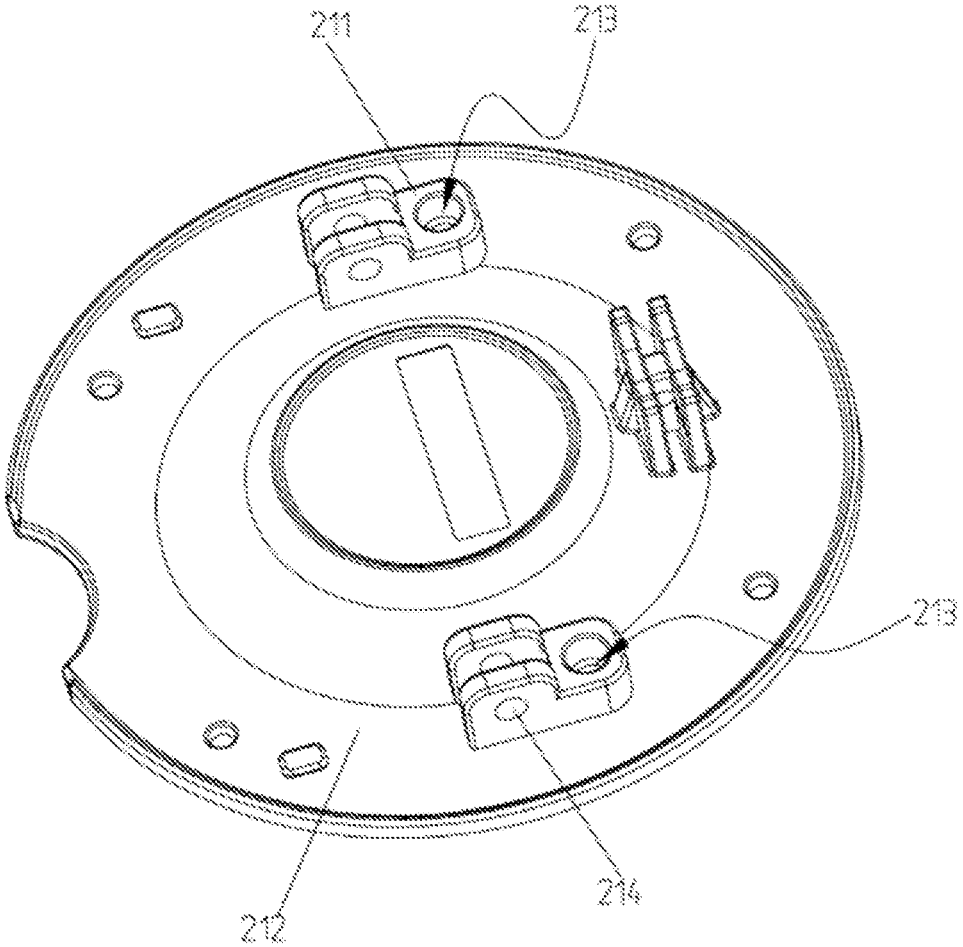
FIG. 3 is a three-dimensional structure diagram of a flapper body of the present disclosure.
Figure 4:
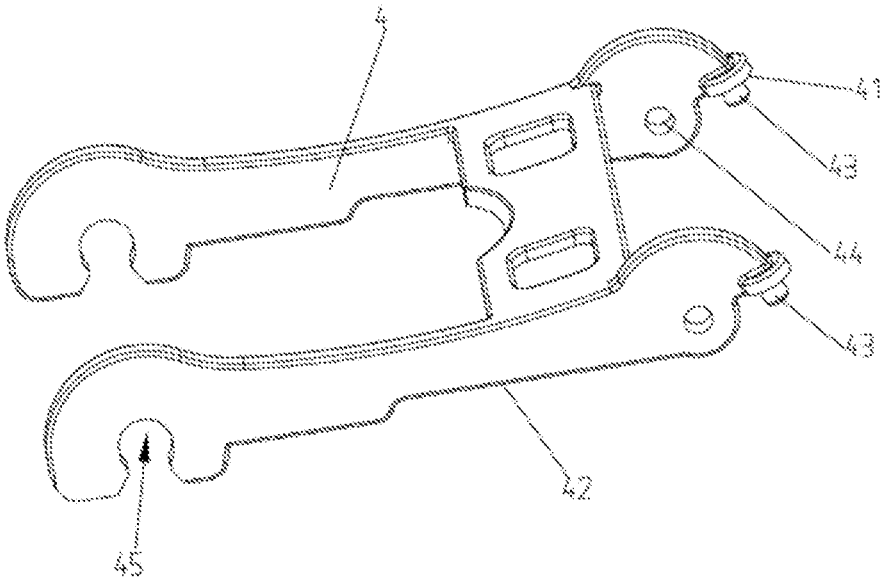
FIG. 4 is a three-dimensional structure diagram of a connecting rod of the present disclosure.
Figure 5:
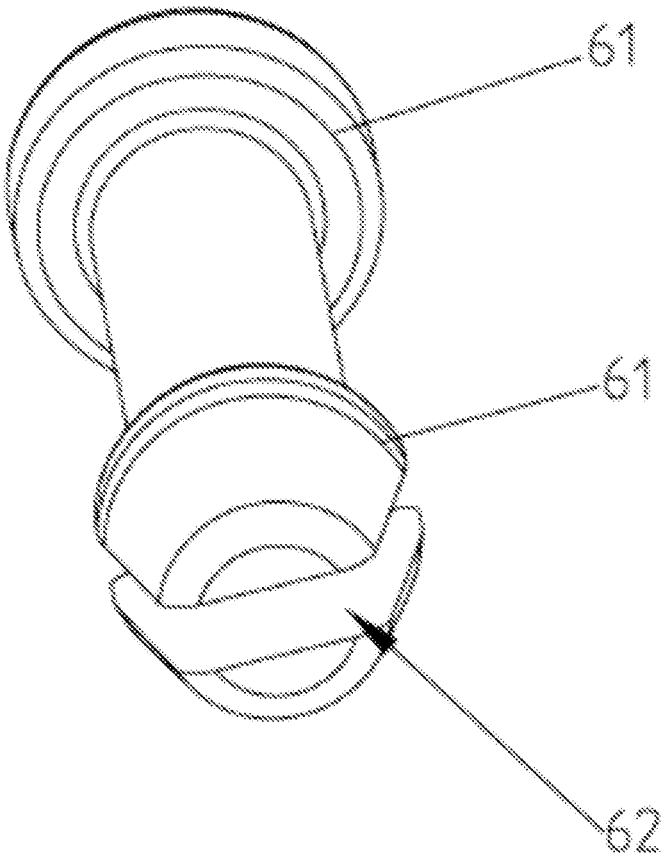
FIG. 5 is a three-dimensional structure diagram of a first rotating shaft of the present disclosure.

Referring to FIGS. 1 and 2, in this embodiment, the actuator 3 is a chain, and one end of the chain is connected to the top of the flapper body 21. Of course, in other embodiments, the actuator 3 may also be a pull cord, and the specific implementation is not limited thereto.

Referring to FIGS. 1 to 4, in this embodiment, two connecting rods 4 are provided, and the two rods 4 are connected into a whole by a connecting portion (not shown in the figures).

The working principle of this embodiment is briefly described as follows:

In an initial state, the flapper 2 hermetically covers and connects to the drain port 11 of the base 1, and the flapper 2 is in the first position relative to the connecting rod 4, and the third limiting face 212 and the fourth limiting face 42 abut against and are in limiting fit with each other under the action of the elastic resetting element 5.

Figure 7:
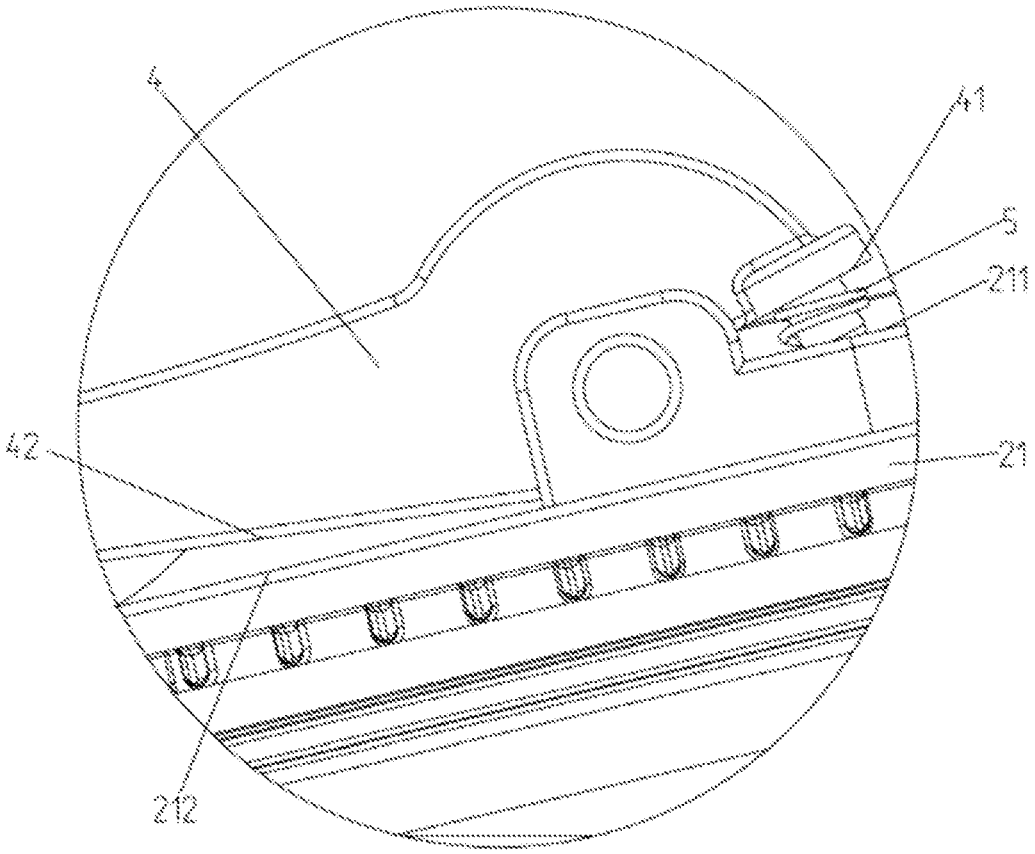
FIG. 7 is a partial enlarged diagram at A in FIG. 6.
Figure 10:
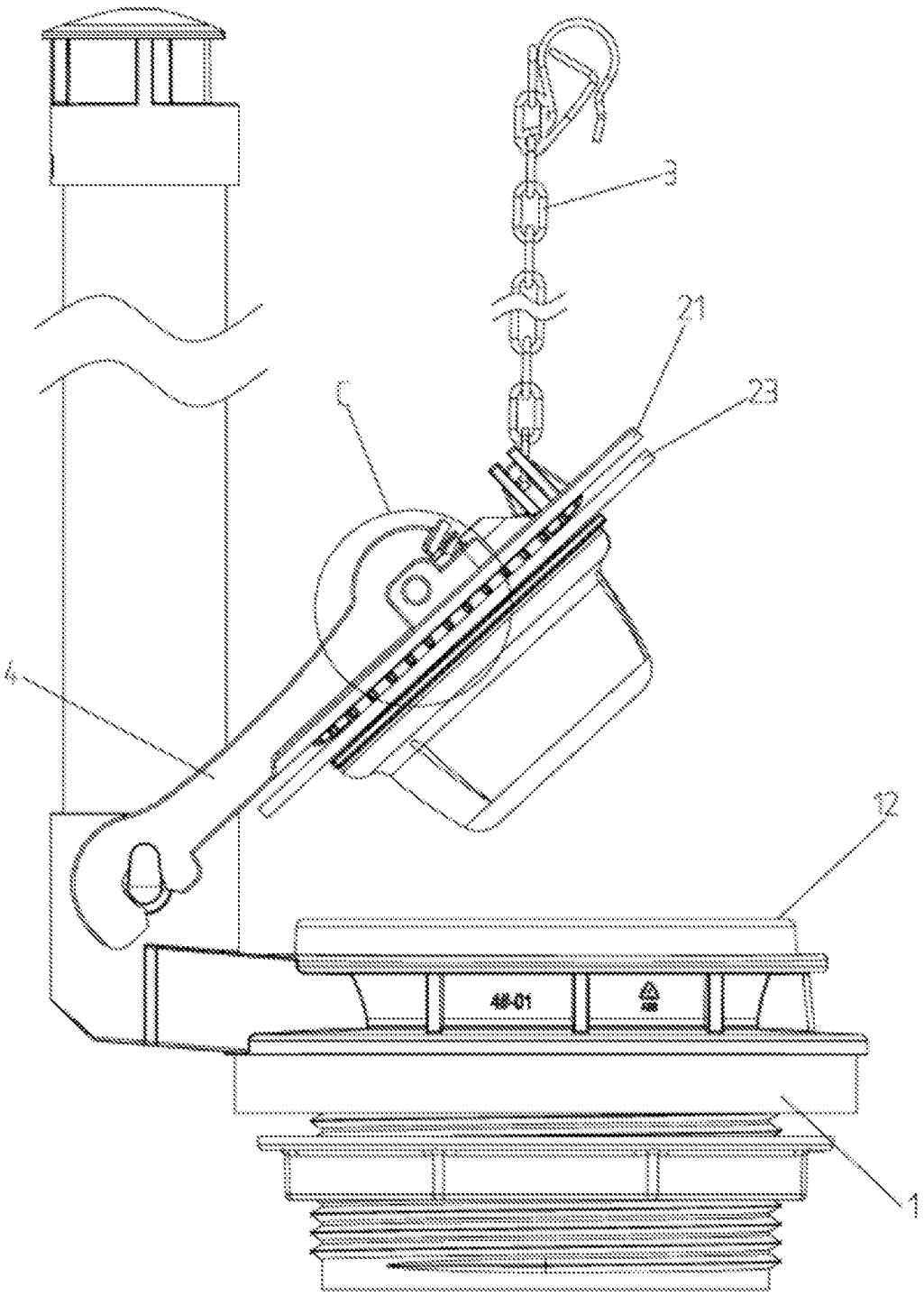
FIG. 10 is a state diagram of the present disclosure when further opening of the drain port is completed.
Figure 11:
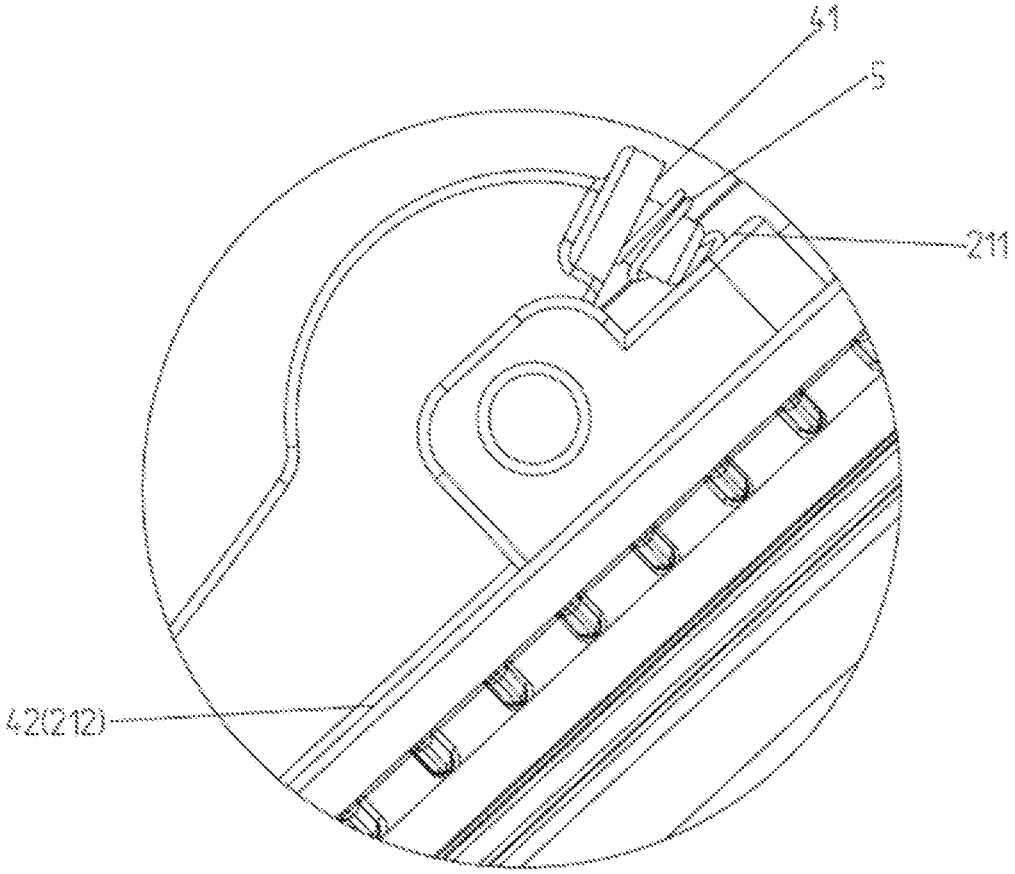
FIG. 11 is a partial enlarged diagram at C in FIG. 10.

As shown in FIGS. 6 and FIG. 7, when water discharge is needed, the actuator 3 is pulled up, such that a first rotation pivot Q1 is formed at a position where the flapper 2 is in contact with the base 1 (specifically a position where the water stop pad 23 and the water stop face 12 are in contact with each other), the actuator 3 causes the flapper 2 to rotate relative to the connecting rod 4 toward the second position, the third limiting face 212 and the fourth limiting face 42 separate from each other, at the same time the actuator 3 causes the flapper 2 to rotate about the first rotation pivot Q1, the elastic resetting element 5 is gradually compressed, the guide post 43 is gradually inserted into the accommodating slot 213, the connecting rod 4 also rotates relative to the base 1 at a small amplitude under the drive of the flapper 2, until the first limiting face 211 and the second limiting face 41 abut against and come into limiting fit with each other, as shown in FIGS. 8 and 9; at that time, the flapper 2 rotates relative to the connecting rod 4 to the second position, the flapper 2 rotates a certain angle relative to the base 1, and the water stop pad 23 and the water stop face 12 are still in contact (i.e. the first rotation pivot Q1 is still formed at the position where the flapper 2 is in contact with the base 1, but the first rotation pivot Q1 on the water stop face 12 is displaced a small distance in a direction away from the second rotation pivot Q2), thus accomplishing initial opening of the drain port 11; the actuator 3 is further pulled upward, such that the water stop pad 23 and the water stop face 12 begin to separate, the flapper 2 and the connecting rod 4 starts to simultaneously rotate about the second rotation pivot Q2, and under the action of the elastic resetting element 5, the flapper 2 gradually rotates and returns to the first position relative to the connecting rod 4 from the second position, the guide post 43 exits the accommodating slot 213, and the first limiting face 211 separates from the second limiting face 41, until the connecting rod 4 rotates to a preset angle relative to the base 1, as shown in FIGS. 10 and 11, thus accomplishing further opening of the drain port 11; and after a pulling force applied to the actuator 3 is removed, the connecting rod 4 rotates and returns under the action of its gravity and the gravity of the flapper 2, and the flapper 2 hermetically covers and connects to the drain port 11 of the base 1 again, thus completing water discharge.

It is to be noted that the first rotation pivot Q1 is a movable rotation pivot; that is, during initial opening of the drain port 11, the first rotation pivot Q1 formed at the position where the flapper 2 is in contact with the base 1 moves in a direction away from a rotational connection between the connecting rod 4 and the base 1 (i.e. the second rotation pivot Q2); using the direction shown in FIG. 6 as an example, the first rotation pivot Q1 gradually moves from left to right with the rotation of the flapper 2.

It can be seen from the above description of the present disclosure that the structure of the present disclosure is simple, and by rotationally connecting the connecting rod to the flapper, in the state where the flapper hermetically covers and connects to the drain port, as the actuator is driven, the actuator is capable of causing the flapper to rotate relative to the connecting rod, and the actuator is capable of simultaneously causing the flapper to rotate about the first rotation pivot formed at the position where the flapper is in contact with the base to initially open the drain port; and in the state where the drain port is initially opened, the actuator is capable of causing the flapper and the connecting rod to rotate together about the second rotation pivot formed at the rotating connection between the connecting rod and the base to further open the drain port. Compared with the existing flap-type drain valve, the present disclosure has the advantages that in the process of initial opening of the drain port, the resistance arm and the power arm are both smaller than those in the prior art, and the ratio of the resistance arm to the power arm is also smaller than that in the prior art, so the pulling force required to pull the flapper is smaller, thereby achieving improvement of the pulling force value; in the process of further opening of the drain port, since the flapper has rotated a certain angle relative to the base and the drain port has been opened initially, the pressure applied to the flapper by water is reduced, and the pulling force required to pull the flapper is also reduced accordingly; at that time, appropriately increasing the resistance arm and the power arm, on the one hand, can keep the pulling force within a range of smaller values, and on the other hand, can ensure that the opening amplitude of the drain port is large enough to ensure a water discharge speed of the drain port, thereby achieving improvement of the pulling force value required to pull the flapper on the premise of ensuring normal water discharge.

The present disclosure cleverly uses a stagewise water discharge method, which greatly reduces the force value of pulling the flapper in the initial opening stage of the drain port; and after the initial opening stage of the drain port, the resistance arm and the power arm are increased by the change of the rotation pivot, to ensure that the drain port can be fully opened, and in the further opening stage of the drain port, since the flapper has rotated a certain angle relative to the base, the water pressure on the flapper is smaller at that time, and thus the increase of the resistance arm and the power arm does not lead to an increase in pulling force, such that the entire process of pulling the flapper has a low pulling force value, and opening the drain valve is more effort-saving.

The above embodiment is only used to further describe the effort-saving flap-type drain valve of the present disclosure, but the present disclosure is not limited thereto. Any simple alterations, equivalent changes and modifications to the above embodiments based on the technical essence of the present disclosure shall fall into the protection scope of the technical solution of the present disclosure.

The invention claimed is:

1. An effort-saving flap-type drain valve, comprising:

a base with a drain port;

a flapper capable of hermetically covering and connecting to the drain port;

an actuator connected to the flapper; and a connecting rod rotationally connected to the base and the flapper at two ends respectively;

wherein in a state where the flapper hermetically covers and connects to the drain port, as the actuator is driven, the actuator is capable of causing the flapper to rotate relative to the connecting rod, and the actuator is capable of simultaneously causing the flapper to rotate about a first rotation pivot formed at a position where the flapper is in contact with the base to initially open the drain port; and in a state where the drain port is initially opened, the actuator is capable of causing the flapper and the connecting rod to rotate together about a second rotation pivot formed at a rotational connection between the connecting rod and the base to further open the drain port;

wherein the flapper is capable of rotating between a first position and a second position relative to the connecting rod, in a state where the flapper is in the first position, the flapper is capable of hermetically covering and connecting to the drain port after falling down; and in a state where the flapper hermetically covers and connects to the drain port, as the actuator is driven, the actuator is capable of causing the flapper to rotate from the first position to the second position relative to the connecting rod, and capable of simultaneously causing the flapper to rotate about the first rotation pivot to initially open the drain port.

2. The effort-saving flap-type drain valve according to claim 1, wherein a first limiting structure is provided between the flapper and the connecting rod, the first limiting structure being capable of limiting an amplitude of rotation of the flapper relative to the connecting rod in the state where the drain port is initially opened, thereby limiting a size of initial opening of the drain port.

3. The effort-saving flap-type drain valve according to claim 2, wherein the first limiting structure comprises a first limiting face provided on the flapper and a second limiting face provided on the connecting rod, the first limiting face being capable of abutting against the second limiting face to limit a magnitude of rotation of the flapper relative to the connecting rod in the state where the drain port is initially opened.

4. The effort-saving flap-type drain valve according to claim 1, wherein an elastic resetting element is provided between the flapper and the connecting rod, and the elastic resetting element is capable of resetting the flapper from the second position to the first position.

5. The effort-saving flap-type drain valve according to claim 4, wherein a second limiting structure is provided between the flapper and the connecting rod, in the state where the flapper is in the first position, the second limiting structure only allowing the flapper to rotate unidirectionally in a direction toward the second position relative to the connecting rod.

6. The effort-saving flap-type drain valve according to claim 5, wherein the second limiting structure comprises a third limiting face on the flapper and a fourth limiting face on the connecting rod, the third limiting face being capable of abutting against the fourth limiting face to limit the flapper in the first position so as to only rotating unidirectionally in the direction toward the second position.

7. The effort-saving flap-type drain valve according to claim 4, wherein the first limiting face is provided with a guide post, and the elastic resetting element is a spring sleeved on the guide post; the second limiting face is provided with an accommodating slot for insertion of the guide post and the spring; and the spring abuts against the first limiting face and a bottom wall of the accommodating slot; or the second limiting face is provided with a guide post, and the elastic resetting element is a spring sleeved on the guide post; the first limiting face is provided with an accommodating slot for insertion of the guide post and the spring; and the spring abuts against the second limiting face and a bottom wall of the accommodating slot.

8. The effort-saving flap-type drain valve according to claim 1, wherein the flapper comprises a flapper body, a shell mounted at the bottom of the flapper body, and a water stop pad mounted at the bottom of the flapper body, wherein an air chamber being formed between the shell and the flapper body, the base being provided with a water stop face at the periphery of the drain port, the water stop pad being capable of sealing against the water stop face so that the flapper hermetically covers and connects to the drain port, or being capable of separating from the water stop face so that the flapper opens the drain port; and in a process of initial opening of the drain port, the first rotation pivot is formed at a position where the water stop pad and the water stop face are in contact with each other.

9. The effort-saving flap-type drain valve according to claim 1, wherein in a process of initial opening of the drain port, the first rotation pivot moves in a direction away from the second rotation pivot.

10. The effort-saving flap-type drain valve according to claim 2, wherein the first limiting structure limits the amplitude of rotation of the flapper relative to the connecting rod to 5°-60°.

11. The effort-saving flap-type drain valve according to claim 10, wherein the first limiting structure limits the amplitude of rotation of the flapper relative to the connecting rod to 7°-25°.

12. The effort-saving flap-type drain valve according to claim 2, wherein the flapper is capable of rotating between a first position and a second position relative to the connecting rod, and an elastic resetting element is provided between the flapper and the connecting rod, and the elastic resetting element is capable of resetting the flapper from the second position to the first position; in a state where the flapper is in the first position, the flapper is capable of hermetically covering and connecting to the drain port after falling down; and in a state where the flapper hermetically covers and connects to the drain port, as the actuator is driven, the actuator is capable of causing the flapper to rotate from the first position to the second position relative to the connecting rod, and capable of simultaneously causing the flapper to rotate about the first rotation pivot to initially open the drain port.

13. The effort-saving flap-type drain valve according to claim 3, wherein the flapper is capable of rotating between a first position and a second position relative to the connecting rod, and an elastic resetting element is provided between the flapper and the connecting rod, and the elastic resetting element is capable of resetting the flapper from the second position to the first position; in a state where the flapper is in the first position, the flapper is capable of hermetically covering and connecting to the drain port after falling down; and in a state where the flapper hermetically covers and connects to the drain port, as the actuator is driven, the actuator is capable of causing the flapper to rotate from the first position to the second position relative to the connecting rod, and capable of simultaneously causing the flapper to rotate about the first rotation pivot to initially open the drain port.

* * * * *